US012275118B2

(12) United States Patent
Mao et al.

(10) Patent No.: US 12,275,118 B2
(45) Date of Patent: Apr. 15, 2025

(54) HIGH-PRESSURE WATER JET SHEET STRIP SAND-BLASTING DESCALING CLEANING DEVICE, CLEANING LINE AND SYSTEM

(71) Applicant: CHANGSHA RESEARCH INSTITUTE OF MINING AND METALLURGY CO., LTD., Hunan (CN)

(72) Inventors: Guiting Mao, Changsha (CN); Dengpei Ouyang, Changsha (CN); Yi Ke, Changsha (CN); Zhimou Liu, Changsha (CN); Dekul Han, Changsha (CN); Yafei Ding, Changsha (CN)

(73) Assignee: CHANGSHA RESEARCH INSTITUTE OF MINING AND METALLURGY CO., LTD., Hunan (CN)

( * ) Notice: Subject to any disclaimer, the term of this patent is extended or adjusted under 35 U.S.C. 154(b) by 1164 days.

(21) Appl. No.: 17/059,292

(22) PCT Filed: May 31, 2019

(86) PCT No.: PCT/CN2019/089559
§ 371 (c)(1),
(2) Date: Nov. 27, 2020

(87) PCT Pub. No.: WO2019/228507
PCT Pub. Date: Dec. 5, 2019

(65) Prior Publication Data

US 2021/0138607 A1 May 13, 2021

(30) Foreign Application Priority Data

May 31, 2018 (CN) ..... 201810553257.8
Nov. 28, 2018 (CN) ..... 201811434614.5
Nov. 28, 2018 (CN) ..... 201811435735.1

(51) Int. Cl.
*B24C 1/08* (2006.01)
*B24B 9/10* (2006.01)
(Continued)

(52) U.S. Cl.
CPC ..... *B24C 1/086* (2013.01); *B24C 3/12* (2013.01); *B24C 3/14* (2013.01); *B24C 9/00* (2013.01); *B24B 9/102* (2013.01); *B24B 27/0069* (2013.01)

(58) Field of Classification Search
CPC ..... B65G 39/18; B65G 39/09; F16J 15/4476; F16C 33/80; B65H 5/066; B65H 5/068;
(Continued)

(56) References Cited

U.S. PATENT DOCUMENTS 1,829,599 A * 10/1931 McCrery ..... B24C 3/12 451/87
2,637,951 A * 5/1953 White ..... B24B 21/00 451/302
(Continued)

FOREIGN PATENT DOCUMENTS

CN 1134677 A 10/1996
CN 102896584 A 1/2013
(Continued)

OTHER PUBLICATIONS

International Search Report in the international application No. PCT/CN2019/089559, mailed on Aug. 16, 2019, 3 pgs.
(Continued)

*Primary Examiner* — Makena S Markman
(74) *Attorney, Agent, or Firm* — Cooper Legal Group, LLC

(57) ABSTRACT

A high-pressure water jet sheet strip sand-blasting descaling cleaning device, a cleaning line and a system are disclosed. The cleaning device includes a cleaning box (7), a washing
(Continued)

box (18) and descaling nozzles (6), the descaling nozzles (6) face to the same width direction of a sheet strip (5) and are arranged in a gradient along a conveying direction of the cleaning box (7) to jet covering the sheet strip (5). The system includes the cleaning device, an abrasive collecting box, a high-pressure water supply system, an abrasive supply-recovery-separation system and a sewage recycling treatment system. The nozzles are slantwise arranged in a gradient along the conveying direction, and the neighboring nozzles do not interfere with each other, and are used for cleaning successively, so that a cleaning process is stable and controllable. A high-pressure water jet sand-blasting cleaning technology is combined with a sheet strip conveying system, different specifications of sheet strips can be continuously and stably conveyed while surfaces thereof are cleaned by using the high-pressure water jet sand-blasting acid-free cleaning technology.

17 Claims, 13 Drawing Sheets

(51) Int. Cl.
*B24B 27/00* (2006.01)
*B24C 3/12* (2006.01)
*B24C 3/14* (2006.01)
*B24C 9/00* (2006.01)

(58) Field of Classification Search
CPC ..... B65H 5/064; B65H 5/062; B24B 9/002; B24B 9/005; B24B 9/10; B24B 9/102; B24C 1/086; B24C 1/083; B24C 3/08; B24C 3/083; B24C 3/12; B24C 9/003; B24C 9/006; B24C 7/007
USPC ..... 193/35 R, 37; 451/38, 81, 39, 87
See application file for complete search history.

(56) References Cited

U.S. PATENT DOCUMENTS

| | | | | |
|---|---|---|---|---|
| 2,837,876 | A * | 6/1958 | Kocher | B24B 9/102 451/301 |
| 3,800,477 | A * | 4/1974 | Jendrisak | B24B 21/002 451/301 |
| 4,174,593 | A | 11/1979 | Maeda | |
| 4,251,956 | A | 2/1981 | Hirata | |
| 5,025,917 | A * | 6/1991 | Smith | F16C 13/022 384/480 |
| 5,107,629 | A * | 4/1992 | Boyd | B28B 11/0818 451/36 |
| 5,884,643 | A * | 3/1999 | Shimizu | B21B 45/08 72/39 |
| 6,257,034 | B1 * | 7/2001 | Fukumori | B21B 1/26 72/201 |
| 6,478,662 | B1 * | 11/2002 | Krejcik | B24C 1/086 451/75 |
| 8,757,357 | B2 * | 6/2014 | Guo | H01L 21/68 198/375 |
| 11,219,933 | B2 * | 1/2022 | Davi | B21D 5/004 |
| 2005/0098412 | A1 * | 5/2005 | Uh | B65G 13/12 198/817 |
| 2005/0116397 | A1 * | 6/2005 | Kimura | B24C 3/14 266/135 |
| 2005/0160780 | A1 | 7/2005 | Kimura | |
| 2013/0277175 | A1 * | 10/2013 | Campbell | B65G 67/08 198/586 |
| 2015/0314337 | A1 * | 11/2015 | Duan | B08B 3/02 29/890.09 |
| 2016/0008950 | A1 * | 1/2016 | Quan | B21B 45/08 451/75 |

FOREIGN PATENT DOCUMENTS

| | | | |
|---|---|---|---|
| CN | 103264355 | A | 8/2013 |
| CN | 203197755 | U | 9/2013 |
| CN | 203371394 | U | 1/2014 |
| CN | 103639906 | A | 3/2014 |
| CN | 103909102 | A | 7/2014 |
| CN | 203726343 | U | 7/2014 |
| CN | 103962400 | A | 8/2014 |
| CN | 107116481 | A | 9/2017 |
| CN | 107717759 | A | 2/2018 |
| CN | 107755437 | A | 3/2018 |
| CN | 107962503 | A | 4/2018 |
| CN | 108032228 | A | 5/2018 |
| CN | 108161763 | A | 6/2018 |
| CN | 207465022 | U | 6/2018 |
| CN | 207788674 | U | 8/2018 |
| CN | 207792033 | U | 8/2018 |
| CN | 108515463 | A | 9/2018 |
| CN | 208289708 | U | 12/2018 |
| CN | 109318132 | A | 2/2019 |
| CN | 109397115 | A | 3/2019 |
| CN | 209304371 | U | 8/2019 |
| CN | 209304372 | U | 8/2019 |
| DE | 4302331 | A1 | 8/1994 |
| JP | H07178439 | A | 7/1995 |
| JP | 2003305647 | A | 10/2003 |
| JP | 2004074021 | A | 3/2004 |
| JP | 2006082115 | A | 3/2006 |
| JP | 2010131520 | A | 6/2010 |
| JP | 2014083578 | A | 5/2014 |
| JP | 2015231617 | A | 12/2015 |
| KR | 101486976 | B1 | 1/2015 |
| WO | 2006048078 | A1 | 5/2006 |

OTHER PUBLICATIONS

English translation of the Written Opinion of the International Search Authority in the international application No. PCT/CN2019/089559, mailed on Aug. 16, 2019, 6 pgs.

* cited by examiner

HIGH-PRESSURE WATER JET SHEET STRIP SAND-BLASTING DESCALING CLEANING DEVICE, CLEANING LINE AND SYSTEM

TECHNICAL FIELD

The disclosure relates to the technical field of sand-blasting cleaning devices, and in particular to a push-pull-type high-pressure water jet sheet strip sand-blasting descaling cleaning device, a water jet cleaning line and a system.

BACKGROUND

Existing methods for removing surface scales of a wide-sheet strip mainly include: 1. a chemical method (namely pickling); 2. mechanical cleaning (it is mainly bending peeling and friction removing); and 3. a shot-blasting/sand-blasting method. The above chemical method may generate a large amount of industrial waste water and waste gas which causes serious pollution to the environment, and the production efficiency of the method is low. With the mechanical cleaning method, it is not high in surface quality, and difficult to meet application requirements. Dust pollution may be generated by using the shot-blasting sand-blasting treatment, which does harm to a body of a worker, and has a large power consumption.

Along with applications of metal strip high-pressure water jet sand-blasting cleaning production lines in steel plants everywhere, the above chemical, mechanical and shot-blasting processes or methods are gradually replaced by a method for removing sheet strip surface scales by using a high-pressure water jet sand-blasting descaling technology. In particular, surface quality, hardness and other aspects of medium and narrow specifications of sheet strips treated by the metal strip high-pressure water jet sand-blasting cleaning production line approach or even exceed those of the medium and narrow specifications of the sheet strips treated by processes such as pickling. In addition, the metal strip high-pressure water jet sand-blasting cleaning production line utilizing the high-pressure water jet sand-blasting descaling technology not only has no discharge of waste acid, waste water and waste residues, is green and environment-friendly, but also has high production efficiency and low operating cost.

However, because the application of the high-pressure water jet sand-blasting descaling technology is still limited to plain carbon steel medium and narrow sheet strips of which a width is less than or equal to 800 mm and a surface quality requirement is low, most of the wide and thick specifications of the sheet strips which occupy a larger domestic market and have a higher technical added value still use high-pollution processes or methods such as chemical, mechanical and shot-blasting methods to perform descaling work before cold rolling, and it is greatly harmful to human and environment. Existing high-pressure water jet sand-blasting descaling technology and device adopt uncoiling/coiling continuous-type conveying, during cleaning, one surface of the sheet strip is cleaned by sand-blasting, and the other surface is supported by a metal plate, as to prevent the sheet strip from being subjected to the high-pressure water jet sand-blasting impact to generate continuous vibration which affects the cleaning effect. Accordingly, this method is suitable for cleaning a thin-sheet strip and a narrow-sheet strip. For a medium-thick steel strip (material) and a wide steel strip (material) with the high surface cleaning quality requirement, there are problems such as difficulties in stable conveying, surface scratches, and uneven surface qualities. Design and installation requirements for the entire production line are quite high, it is not beneficial to industrial applications and later maintenance.

In addition, an existing sheet strip conveying mechanism is mainly designed in allusion to sheet strip hot rolling line and cold rolling line, in which the sheet strip is conveyed mainly by clamping of a clamping roller and pulling of a crimpling machine or by conveying rollers, and the sheet strip is always only subjected to a pulling force or a pushing force along the conveying direction of the sheet strip. While if the sheet metal surface is cleaned by using high-pressure water jet sand-blasting without an acid with an existing sheet strip conveying mechanism, in order to prevent descaling nozzles from directly spraying on conveying rollers and side limiting rollers, the spraying direction of the descaling nozzles in a cleaning box should be perpendicular to the conveying direction of the sheet strip. That is, the sheet strip is not only continuously subjected to the pulling force or the pushing force along the conveying direction of the sheet strip, but also subjected to a pushing force from the jet of the descaling nozzles that are perpendicular to the conveying direction of the sheet strip at a corresponding sand-blasting cleaning position while the sheet strip is conveyed to the spraying position of the descaling nozzle for cleaning, so the sheet strip may be deviated from the original conveying direction. It would not be beneficial to perform coverage-type sand-blasting treatment on a sheet strip surface by a high-pressure water jet sand-blasting acid-free cleaning process with the existing sheet strip conveying mechanism, therefore such conveying mechanism may not be used in a cleaning line for high-pressure water jet sand-blasting acid-free cleaning.

SUMMARY

A purpose of the disclosure is to provide a high-pressure water jet sheet strip sand-blasting descaling cleaning device, a water jet cleaning line and a system, as to solve the above problems.

In order to achieve the above purpose, a technical scheme of the disclosure is as follows: a high-pressure water jet sheet strip sand-blasting descaling cleaning device, including a cleaning box, a washing box and descaling nozzles for jetting and cleaning a sheet strip, the washing box is arranged at an output end of the cleaning box, the descaling nozzles face to a same width direction of the sheet strip and are arranged in a gradient along a conveying direction of the cleaning box to jet covering the sheet strip.

Further, upper and lower sides of the sheet strip are respectively provided with the descaling nozzles, and the descaling nozzles are symmetrically arranged relative to the sheet strip.

Further, the descaling nozzles jet and diffuse on the sheet strip to form a jet influence area, the jet influence area includes a jet cleaning area which has a direct jet cleaning effect on the sheet strip, and the jet influence area formed by the descaling nozzles firstly entering above the sheet strip is adjacent to or partially overlapped with the jet cleaning area formed by the descaling nozzles secondly entering above the sheet strip.

Further, an input end of the cleaning box and an output end of the washing box are provided with clamping mechanisms for pushing and pulling the sheet strip, the clamping mechanism includes rolling conveying wheels for clamping up and down to roll the sheet strip.

Further, the device further includes multiple groups of intra-cleaning-box horizontal conveying rollers for conveying the sheet strip, the intra-cleaning-box horizontal conveying rollers form a conveying line for conveying the sheet strip, and two sides of the conveying line are provided with side guide rollers of which relative positions are adjustable.

Further, two descaling nozzles symmetrically arranged relative to the sheet strip form a nozzle group, multiple neighboring nozzle groups form a descaling unit, the intra-cleaning-box horizontal conveying rollers and the side guide rollers are interval-arranged along the conveying line, the descaling unit is arranged between the intra-cleaning-box horizontal conveying rollers and the side guide rollers, and an orientation of the descaling nozzles is perpendicular to a moving direction of the sheet strip.

Further, the side guide rollers include intra-cleaning-box fixed side guide rollers and adjustable side guide rollers;

the intra-cleaning-box fixed side guide rollers are fixedly arranged at one side of the sheet strip along the conveying direction and at the side of a jet direction of the descaling nozzles.

the adjustable side guide rollers are arranged at the other side of the sheet strip along the conveying direction, and positioned at the outer sides of the intra-cleaning-box fixed side guide rollers at the outermost sides close to respective entrance and exit of the cleaning box, while the sheet strip leaves the adjustable side guide rollers and is cleaned midway in the cleaning box, width positioning is performed on the sheet strip by the intra-cleaning-box fixed side guide rollers.

Further, in the cleaning box, a distance between axes of any three contiguous intra-cleaning-box fixed side guide rollers and a distance between the axes of the adjustable side guide roller and the 2-nd closest intra-cleaning-box fixed side guide roller to it are less than a length of the sheet strip to be conveyed.

Further, while the sheet strip is cleaned, width limiting is kept performing on the sheet strip by at least two intra-cleaning-box fixed side guide rollers, or by the intra-cleaning-box fixed side guide rollers and the adjustable side guide rollers jointly.

Further, the sides of the entrance and exit of the cleaning box are respectively provided with a conveying roller way for loading sheet strip and a conveying roller way for unloading sheet strip, at the conveying roller way for loading sheet strip and the conveying roller way for unloading sheet strip, two sides of the conveying direction of the sheet strip are provided with loading-unloading side limiting rollers, while the sheet strip is totally or partially positioned on the conveying roller way for loading sheet strip or the conveying roller way for unloading sheet strip, the width limiting is performed on the sheet strip.

Further, the intra-cleaning-box fixed side guide rollers, in the cleaning box, are arranged between two intra-cleaning-box horizontal conveying rollers between which no descaling nozzle is installed.

Further, the adjustable side guide rollers are automatically adjusted and horizontally moved through a side guide adjusting mechanism, as to adapt the sheet strips with different specification widths.

Further, a pressure roller is arranged above the intra-cleaning-box horizontal conveying roller, and the sheet strip is conveyed by being clamped therebetween.

Further, each of the conveying roller way for loading sheet strip and the conveying roller way for unloading sheet strip is composed of two or more horizontal conveying rollers, and pressure rollers are arranged on the horizontal conveying rollers.

Further, the device further includes a loading detection device and an unloading detection device which are respectively arranged on the conveying roller way for loading sheet strip and the conveying roller way for unloading sheet strip for determining a distance or a position to be moved of the loading-unloading side limiting rollers, the adjustable side guide rollers and the pressure rollers by detecting the width in and thickness of the sheet strip.

Further, the intra-cleaning-box horizontal conveying roller includes a roller, and the roller is radially positioned on a support shaft through bearings installed at two ends of the roller;

the intra-cleaning-box horizontal conveying roller is sealed by an intra-cleaning-box horizontal conveying roller sealing device, the intra-cleaning-box horizontal conveying roller sealing device includes sealing disks, the sealing disks are installed on the support shaft and tightly adjacent to two end faces of the roller; and zigzag channels for blocking an abrasive by slowing it down and throwing it out with the help of a centrifugal force are respectively set between the sealing disks and the end faces of the roller.

Further, the zigzag channel is formed by a combination of a groove set on the sealing disk and a groove set on the roller, and openings of the grooves face to a direction away from a center line of the support shaft.

Further, the sealing disks are respectively circumferentially provided with a first groove, and the two end faces of the roller are respectively circumferentially provided with a second groove, the corresponding first and second grooves are staggered arranged to form the zigzag channels, and a boundary of the zigzag channel comprises a plurality of slopes for slowing down bounce of the abrasive.

Further, the intra-cleaning-box fixed side guide roller and/or the adjustable side guide roller adopts a limiting roller as described below, the limiting roller comprises a second roller, which is radially positioned on a second support shaft through second bearings installed at two ends of the second roller, a zigzag channel for blocking the abrasive by slowing it down and throwing it out with the help of the centrifugal force is set between the lower end of the second support shaft and the lower end of the second roller.

Further, the limiting roller further includes a roller cover, the upper end face of the second roller is closely covered by the roller cover to completely seal the upper end of the second roller.

Further, a zigzag channel is formed by a combination of a flange set on the second support shaft and a groove set on the second roller, and a boundary of the zigzag channel includes a plurality of slopes for slowing down bounce of the abrasive.

A water jet cleaning line includes one or more of the above high-pressure water jet sheet strip sand-blasting descaling cleaning devices connected successively.

Further, the water jet cleaning line includes a forward jet cleaning line and a reverse jet cleaning line which are mutually connected, each of the forward jet cleaning line and the reverse jet cleaning line internally includes one or more of high-pressure water jet sheet strip sand-blasting descaling cleaning devices connected successively, the descaling nozzles in the forward jet cleaning line face to the same width direction of the sheet strip, the descaling nozzles in the reverse jet cleaning line face to the same width direction of the sheet strip, and orientations of the descaling nozzles in the forward jet cleaning line and in the reverse jet cleaning line are symmetrically configured relative to a vertical plane perpendicular to the width direction of the sheet strip.

A high-pressure water jet sheet strip sand-blasting descaling cleaning system includes the high-pressure water jet sheet strip sand-blasting descaling cleaning device(s) or the water jet cleaning line(s), and further includes an abrasive collecting box, a high-pressure water supply system, an abrasive supply-recovery-separation system and a sewage recycling treatment system;

the high-pressure water supply system includes a water purifying box and a high-pressure pump, one end of the high-pressure pump is connected with the water purifying box, and the other end is connected with the descaling nozzles;

the abrasive supply-recovery-separation system includes an abrasive tank, an abrasive screening device, a hydraulic conveyer, an overflow collecting box and a hydrocyclone;

the abrasive tank is positioned below the abrasive screening device, one end of the abrasive tank is connected with the abrasive screening device, and the other end is connected with the descaling nozzles;

the cleaning box is positioned below the abrasive tank, and the abrasive collecting box is positioned below the sheet strip;

the hydraulic conveyer is positioned below the abrasive collecting box, one end thereof is connected with the abrasive collecting box and the other end is connected with the abrasive screening device, for sending the collected abrasive back to the abrasive tank;

the overflow collecting box is positioned at an output end of an overflow port of the cleaning box, a water inlet of the hydrocyclone is connected with the overflow collecting box through a slurry pump, an outlet at the lower part of the overflow collecting box is connected with the cleaning box to recover the abrasive, and a water outlet at the upper part of the overflow collecting box is connected with a sedimentation tank for discharging sewage;

the sewage recycling treatment system includes a sewage filter and the sedimentation tank, one end of the sewage filter is connected with the water purifying box, and the other end is connected with the sedimentation tank.

A horizontal limiting roller for the high-pressure water jet sheet strip sand-blasting descaling cleaning device includes a roller, and the roller is radially positioned on a support shaft through bearings installed at two ends of the roller, and further includes sealing disks, which is installed on the support shaft and tightly adjacent to two end faces of the roller; and zigzag channels for blocking an abrasive by slowing it down and throwing it out with the help of a centrifugal force are set between the sealing disks and the end faces of the roller.

A slantwise limiting roller for the high-pressure water jet sheet strip sand-blasting descaling cleaning device includes a second roller, and the second roller is radially positioned on a second support shaft through second bearings installed at two ends of the second roller, a zigzag channel for blocking an abrasive by slow it down and throwing it out with the help of a centrifugal force is set between the lower end of the second support shaft and the lower end of the second roller.

Compared with the prior art, the invention has the following advantages.

The high-pressure water jet sand-blasting cleaning device of the disclosure is capable of, through the symmetrically arranged abrasive homogenizing sprinkler heads above the upper side and below the lower side of the sheet strip, balancing forces on the sheet strip in upper and lower directions during the cleaning process, and avoiding the sand-blasting impact in a single direction to cause sinking or upwarping of the surface of the sheet strip. The nozzles are slantwise arranged in a gradient along the conveying direction, so that the abrasive jetted by the previous nozzle may not be left in the jetting cleaning area of the latter nozzle, namely the neighboring nozzles do not interfere with each other, and the cleaning can be performed successively, thereby the cleaning process is stable and controllable. At the same time, through the horizontal conveying rollers and the clamping mechanism in the cleaning box, the conveying of the sheet strip is more stable and convenient, and rolling friction of the horizontal conveying rollers in the cleaning box is maintained during the conveying process, the surface of the sheet strip is avoided from being scratched and damaged. A cleaning-washing-drying-detecting streamlined operation of the sheet strip is achieved by the water jet cleaning line, so the cleaning efficiency of the sheet strip is improved; and through cleaning in the forward and reverse directions, the surface quality of the sheet strip is improved.

The disclosure is capable of, according to a length of the sheet strip to be cleaned, rationally arrange the loading-unloading side limiting rollers, the intra-cleaning-box fixed side guide rollers and adjustable side guide rollers at two sides of the sheet strip along the conveying direction, preventing the sheet strip from being twisted during the sand-blasting cleaning process even if it is subjected to a vertical force generated by the descaling nozzles that is perpendicular to the conveying direction thereof, and maintaining the stable conveying along the conveying direction. The conveying roller way for loading sheet strip and the conveying roller way for unloading sheet strip are respectively provided with the loading detection device and the unloading detection device, the sheet strip may be rapidly positioned, and the production efficiency is improved. The intra-cleaning-box horizontal conveying rollers or the pressure rollers on the horizontal conveying rollers increase the driving friction of the sheet strip, which guarantee the sheet strips with different specifications entering stably and completing the sand-blasting cleaning through the cleaning box.

The disclosure is capable of combining the high-pressure water jet sand-blasting cleaning technology and the sheet strip conveying system, achieving the continuous stable conveying of the sheet strips with different specifications while the surfaces thereof are cleaned by using the high-pressure water jet sand-blasting acid-free cleaning technology, and achieving automatic efficient cleaning. At the same time, the device of the disclosure is simple and compact in structure, low in cost, convenient in conveying, simple in operation, high in production efficiency, good in surface cleaning effect, and pollution-free, and the surface abrasive after cleaning is easy to be washed and collected.

The disclosure is further described in detail below with reference to drawings.

BRIEF DESCRIPTION OF THE DRAWINGS

The drawings forming a part of the present application are used to provide further understanding of the disclosure, and exemplary embodiments and descriptions thereof are used to explain the disclosure, and do not constitute improper limitation to the disclosure. In the drawings.

ILLUSTRATION OF MARKS

Figure 1:
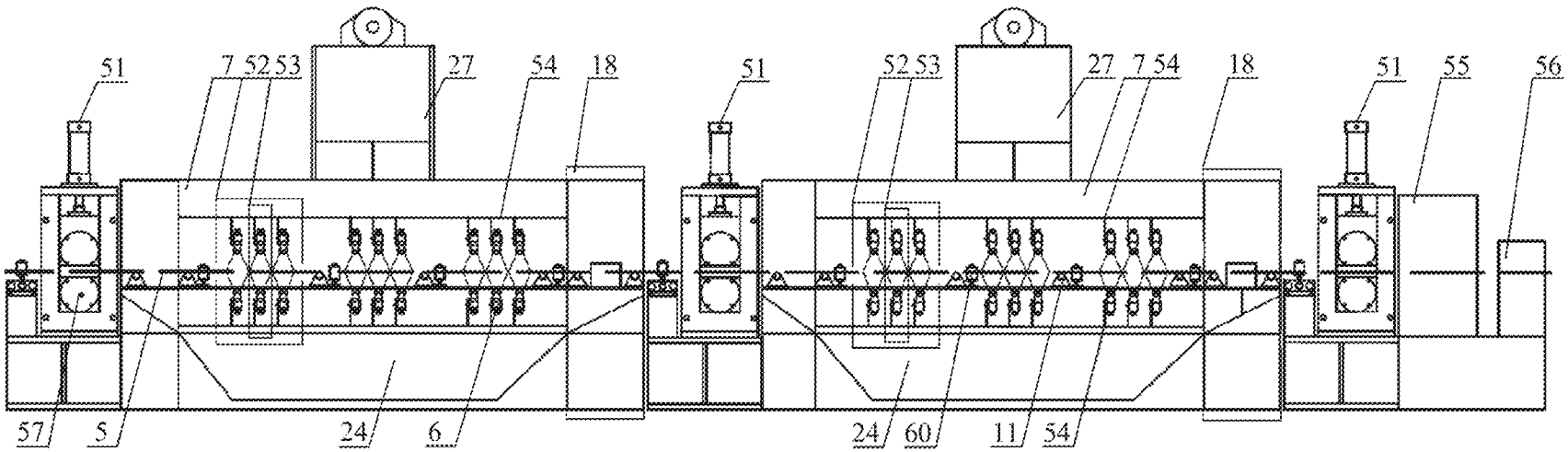
FIG. 1 is a front schematic view of a water jet cleaning line including a high-pressure water jet sheet strip sand-blasting descaling cleaning device disclosed by an embodiment of the disclosure.
Figure 2:
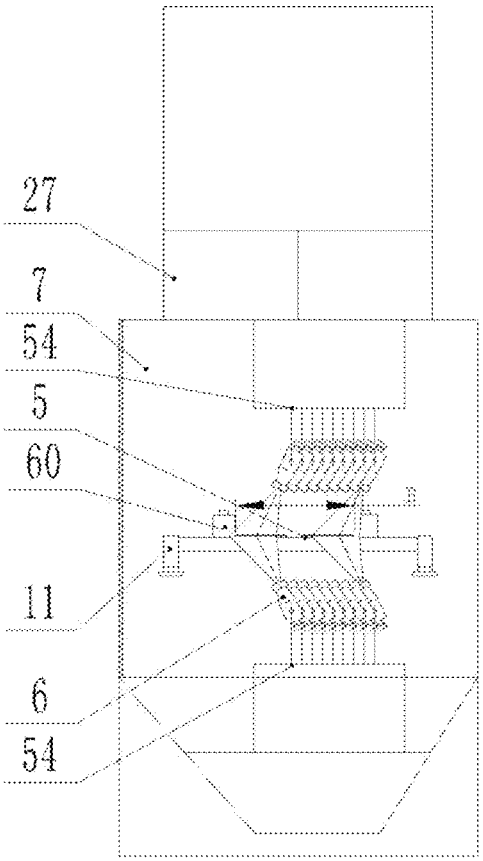
FIG. 2 is a left schematic view of the high-pressure water jet sheet strip sand-blasting descaling cleaning device disclosed by an embodiment of the disclosure.

1. Conveying roller way for loading sheet strip; 2. Conveying roller way for unloading sheet strip; 3. Side positioning pusher; 4. Loading-unloading side limiting roller; 5. Sheet strip; 6. Descaling nozzle; 7. Cleaning box; 8. Pressure roller; 9. Loading detection device; 10. Unloading detection device; 11. Intra-cleaning-box horizontal conveying roller; 12. Intra-cleaning-box horizontal conveying roller sealing device; 13. Intra-cleaning-box fixed side guide roller; 14. Adjustable side guide roller; 15. Side guide adjusting mechanism; 16. Horizontal conveying roller; 17. Sheet strip cleaned area; 18. Washing box; 19. High-pressure washing device; 20. Water purifying box; 21. High-pressure pump; 22. Variable frequency controller; 23. Pressure conveying pipeline; 24. Abrasive collecting box; 25. Descaling nozzle installing frame; 26. Washing device; 27. Abrasive tank; 28. Sand supply pipe; 29. Sand supply control valve; 30. Weight sensor; 31. Abrasive screening device; 32. Hydraulic conveyer; 33. Hydrocyclone; 34. Overflow collecting box; 35. Slurry pump; 36. Hydraulic conveyer auxiliary pump; 37. Sewage filter; 38. Water conveying pipeline; 39. Sedimentation tank; 40. Sewage pump; 41. Recoil pump; 42. Flush steel shot nozzle; 43. High-pressure filtering device; 44. Shaped hard pipe; 45. Abrasive homogenizing sprinkler head; 46. Flushing pump; 47. Valve; 48. Baffle; 49. First cleaning box; 50. Second cleaning box; 51. Clamping mechanism; 52. Descaling unit; 53. Nozzle group; 54. Nozzle installation adjusting mechanism; 55. Drying device; 56. Detection device; 57. Rolling conveying wheel; 58. Jet cleaning area; 59. Jet influence area; 60. Side guide roller; 121. Support shaft; 122. Nut; 123. Support component; 124. Shaft collar; 125. Sealing disk; 126. First sealing element; 127. Sealing ring; 128. Bearing; 129. Roller; 1210. Second sealing element; 1211. Positioning shaft sleeve; 1212. First slope; 1213. Second slope; 1214. Third slope; 1215. Fourth slope; 1216. Fifth slope; 601. 1-st nut; 602. Support element; 603. Second support shaft; 604. Second sealing ring; 605. Second bearing; 606. Second roller; 607. Roller cover; 608. 2-nd nut; 609. 5-th slope; 6010. 4-th slope; 6011. 2-nd slope; 6012. 1-st slope; 6013. 3-rd slope; and 6017. 6-th slope.

DETAILED DESCRIPTION

Embodiments of the disclosure are described in detail below with reference to the drawings, but the disclosure may be implemented in multiple modes defined and covered by claims.

As shown in FIG. 1 to FIG. 5, the disclosure firstly discloses a high-pressure water jet sheet strip sand-blasting descaling cleaning device, including a cleaning box 7, a washing box 18, an abrasive tank 27, an abrasive collecting box 24, descaling nozzles 6 and a clamping mechanism 51, in which the washing box 18 is arranged at an output end of the cleaning box 7, an input end of the cleaning box 7 and an output end of the washing box 18 are respectively provided with the clamping mechanism 51 for pushing and pulling a sheet strip 5 (in the present embodiment, the clamping mechanism 51 is achieved by rolling pushing with tightly pressed rolling conveying wheels 57 arranged symmetrically, compared with other conveying modes, such a conveying mode with the upper and lower rolling conveying wheels 57 guarantee tight clamping of the sheet strip 5 during the entire conveying process even in the case that a high-pressure water jet generates larger side pushing force and impact force, so that factors, such as horizontal lateral movement or vibration of the sheet strip 5, which may affect the surface washing quality of the sheet strip 5 can be further reduced, or an uncoiling taking-up mechanism is used to push the sheet strip 5 moving), to achieve push and then pull of the sheet strip 5 at the same time, and guarantee the continuity of a moving process of the sheet strip 5. The descaling nozzles 6 are connected with the abrasive tank 27, and the abrasive tank 27 is arranged above the cleaning box 7, thereby an abrasive flow with high mass concentration is conveniently conveyed to the descaling nozzles 6, and the descaling nozzles 6 are symmetrically arranged (may also be arranged independently) relative to the sheet strip 5 passing through the cleaning box 7, and the abrasive collecting box 24 is arranged at the bottom of the cleaning box 7.

Figure 3:
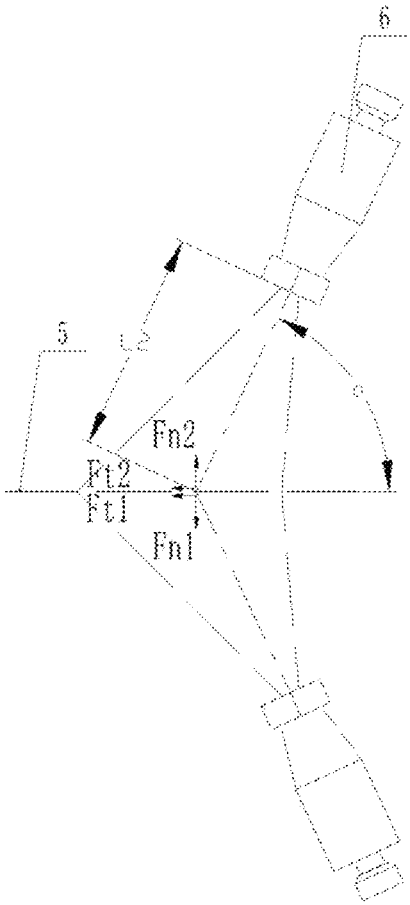
FIG. 3 is a working schematic diagram of a nozzle group disclosed by an embodiment of the disclosure.
Figure 4:
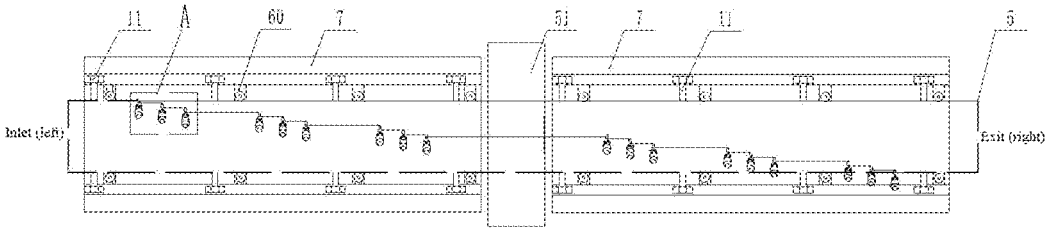
FIG. 4 is a first top schematic view of the water jet cleaning line disclosed by an embodiment of the disclosure.

In the present embodiment, each descaling nozzle 6 is installed on a nozzle installation adjusting mechanism 54 capable of adjusting installation height and installation angle of the descaling nozzle 6. The nozzle installation adjusting mechanism 54 is installed in the cleaning box 7 (the nozzle installation adjusting mechanism 54 may be simple mechanical adjustment such as a screw and a nut, or may be an automatic adjusting lifting or deflecting mechanism driven by a motor), adjustment of an inclination angle $\alpha$ and a target distance $L_2$ of the descaling nozzle 6 may be achieved with the nozzle installation adjusting mechanism 54. Referring to FIG. 3, two descaling nozzles 6 symmetrically arranged relative to the sheet strip 5 passing through the cleaning box 7 compose a nozzle group 53, the descaling nozzles 6 of the nozzle group 53 face to a width direction of the sheet strip 5 passing through the cleaning box 7 and are slantwise arranged in a same inclination angle, namely the descaling nozzles 6 above and below the sheet strip 5 are symmetrically arranged relative to the symmetrical plane of upper and lower surfaces of the sheet strip 5, the inclination angle α and the target distance $L_2$ of the upper descaling nozzle 6 relative to the upper surface are consistent with the inclination angle and the target distance of the lower descaling nozzle 6 relative to the lower surface, an impact resultant force on the sheet strip 5 formed by the upper and lower descaling nozzles 6 is parallel to the width direction of the sheet strip 5, horizontal opposite sand-blasting cleaning (alternatively, slantwise opposite sand-blasting cleaning which has a certain angle relative to the moving direction of the sheet strip 5 in the cleaning box) of the upper and lower surfaces of the sheet strip 5 is achieved, thereby the sinking or upwarping of the surface of the sheet strip 5 is not affected by the impact force of the nozzle group 53.

In the present embodiment, further including multiple groups of intra-cleaning-box horizontal conveying rollers 11 for conveying the sheet strip 5, the intra-cleaning-box horizontal conveying rollers 11 form a conveying line for conveying the sheet strip 5, and two sides of the conveying line are provided with side guide rollers 60 of which relative positions are adjustable. Rotation roller surfaces of the intra-cleaning-box horizontal conveying rollers 11 and the side guide rollers 60 are provided with rubber covers to prevent the sheet strip 5 from being scratched during the conveying process. Through the side guide rollers 60 of which relative positions are adjustable, the sheet strip 5 with different width may be adapted. The clamping mechanisms 51 are arranged before and after the cleaning box 7 to provide stable continuous conveying power, and the intra-cleaning-box horizontal conveying rollers 11 support the sheet strip 5 to be conveyed stably. Under the action of the high-pressure water jet sand-blasting impact force, the sheet strip 5 may generate a side deflecting tendency, the side guide rollers 60 are provided to prevent this tendency from being enlarged. The clamping mechanisms 51, the side guide rollers 60 and the intra-cleaning-box horizontal conveying rollers 11 are cooperated together, as to achieve the stable conveying of the sheet strip 5.

Figure 5:
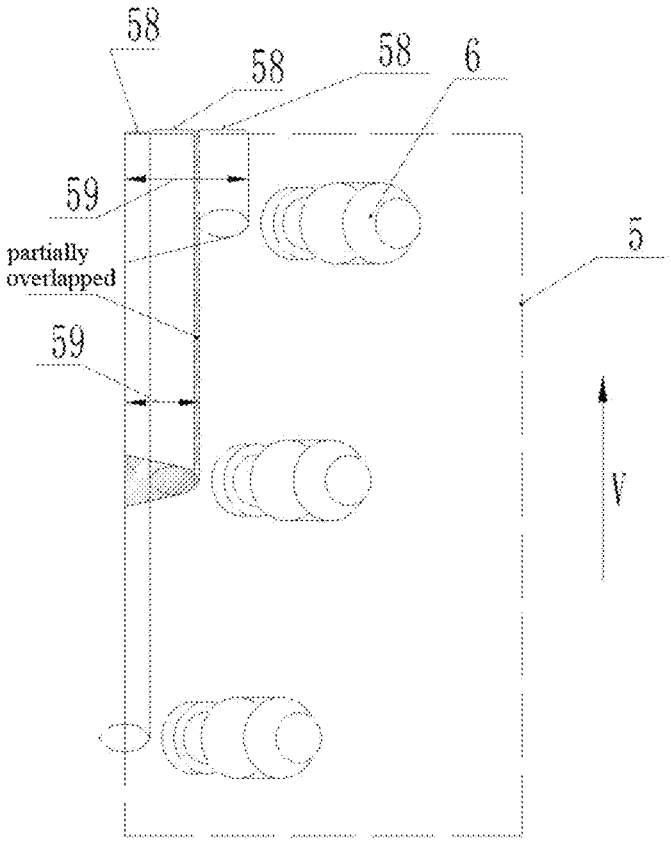
FIG. 5 is an enlarged schematic diagram of part A in FIG. 4.

In the present embodiment, the nozzle group 53 is arranged in an even gradient along a length direction of the sheet strip 5 passing through the cleaning box 7, the descaling nozzles 6 of the nozzle group 53 face to a same width direction of the sheet strip 5, and the descaling nozzles 6 jet and diffuse the abrasive on the sheet strip 5 to form a jet influence area 59. The jet influence area 59 includes a jet cleaning area 58 where the direct jet cleaning effect is acted on the sheet strip 5, in which the jet cleaning area 58 is an area that is directly affected and cleaned by the abrasive jetted by a descaling nozzle 6, and directly faces to the jet direction of the descaling nozzle 6, and the jet influence area 59 is formed by diffusion of a high-pressure abrasive jet flow jetted by the descaling nozzles 6 colliding with the sheet strip 5. In the present embodiment, the jet influence area 59 formed by the descaling nozzle 6 firstly entering above the sheet strip 5 is connected or partially overlapped with the jet cleaning area 58 formed by the descaling nozzle 6 secondly entering above the sheet strip 5. As shown in FIG. 5, in this way, it may be strictly guaranteed that the abrasive jetted by the previous descaling nozzle 6 (namely the descaling nozzle 6 firstly entering above the sheet strip 5) is not left in a jet area corresponding to the latter descaling nozzle 6 (namely the descaling nozzle 6 secondly entering above the sheet strip 5) thereby not affecting the surface cleaning quality of the latter descaling nozzle 6 to the sheet strip 5 (when a descaling nozzle 6 jets, the more abrasive jetted by the descaling nozzle 6 is left in the jet cleaning area 58 of the sheet strip 5, the worse cleaning effect is obtained due to the affections, such as blocking, of the abrasive left in this area if the abrasive jet flow act on the abrasive left in this area), namely, the neighboring descaling nozzles 6 do not interference with each other, and cleaning is performed successively, thereby the cleaning process is uniform, stable and controllable. During specific configuration, in view of factors such as processes and installation accuracy, the jet cleaning area 58 and the jet influence area 59 respectively formed by two neighboring descaling nozzles 6 are overlapped in the width direction of the sheet strip 5, thereby it may be guaranteed that a connection place of the two areas are cleaned, and an uncleaned blind area is avoided from existing in the connection area of the two areas. At the same time, a jet width of the nozzle group 53 is greater than a width of the sheet strip 5, namely a sand-blasting cleaning area of the descaling nozzles 6 in the cleaning box 7 is controlled to be slightly wider than the width B of the sheet strip 5, and a certain side surface of the sheet strip 5 may be covered by the sand-blasting cleaning so that the cleaning operation may be similarly completed on an edge of the sheet strip 5, therefore, the sand-blasting cleaning operations to the upper, lower and side surfaces of the sheet strip 5 with the width B can be achieved within the single cleaning box 7.

In the present embodiment, multiple neighboring nozzle groups 53 form a descaling unit 52, in which the design of the roller side interval of the intra-cleaning-box horizontal conveying rollers 11 is on the basis that the sheet strip 5 can be smoothly conveyed from a previous intra-cleaning-box horizontal conveying roller 11 to a latter intra-cleaning-box horizontal conveying roller 11 during the sand-blasting cleaning, and the intra-cleaning-box horizontal conveying rollers 11 and the side guide rollers 60 can be protected from being directly impacted by sand-blasting of the descaling unit 52, and the damage to the intra-cleaning-box horizontal conveying rollers 11 and the side guide rollers 60 caused by the washing of the high-pressure abrasive jet flow can be avoided, the intra-cleaning-box horizontal conveying rollers 11 and the side guide rollers 60 are interval-arranged along the conveying line, intra-cleaning-box horizontal conveying rollers 11 and the side guide rollers 60 are closely arranged, and the descaling unit 52 is arranged between the intra-cleaning-box horizontal conveying rollers 11 and the side guide rollers 60.

Figure 6:
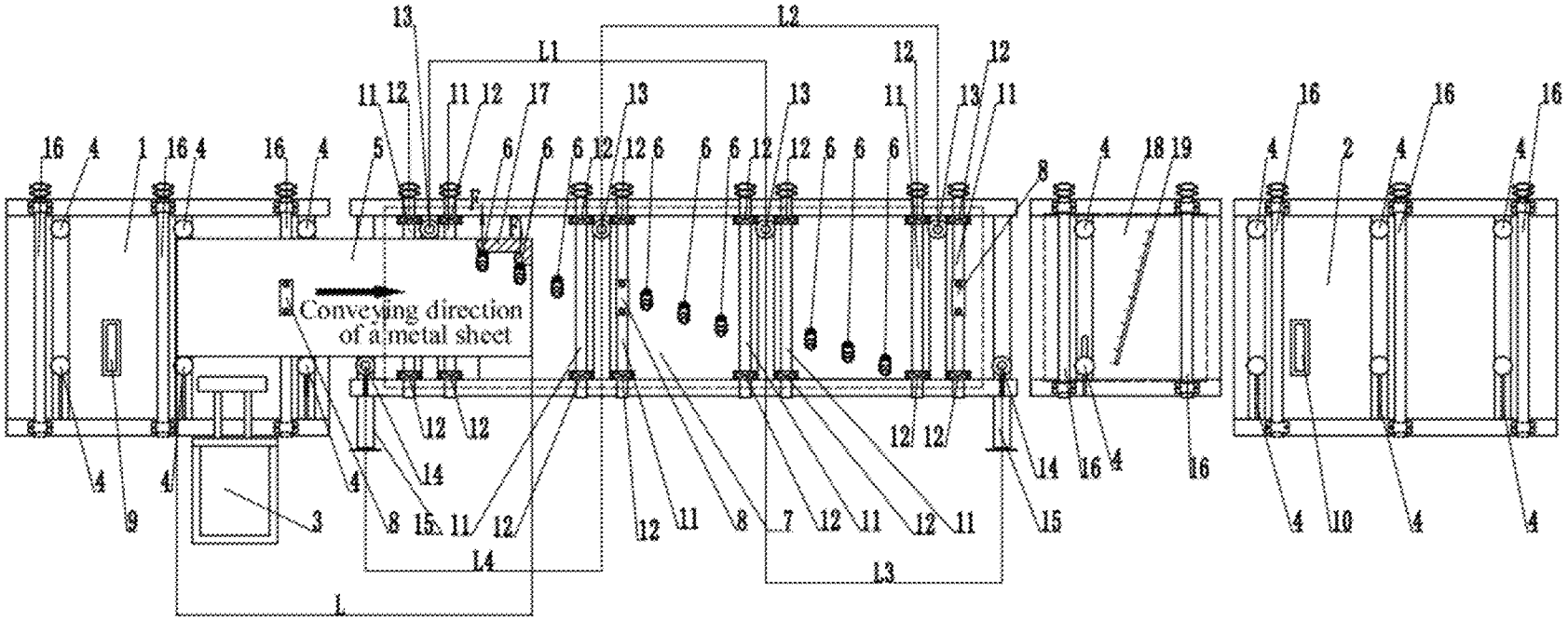
FIG. 6 is a schematic diagram of a relative position of a sheet strip conveying system and a cleaning box and a washing box disclosed by an embodiment of the disclosure.
Figure 8:
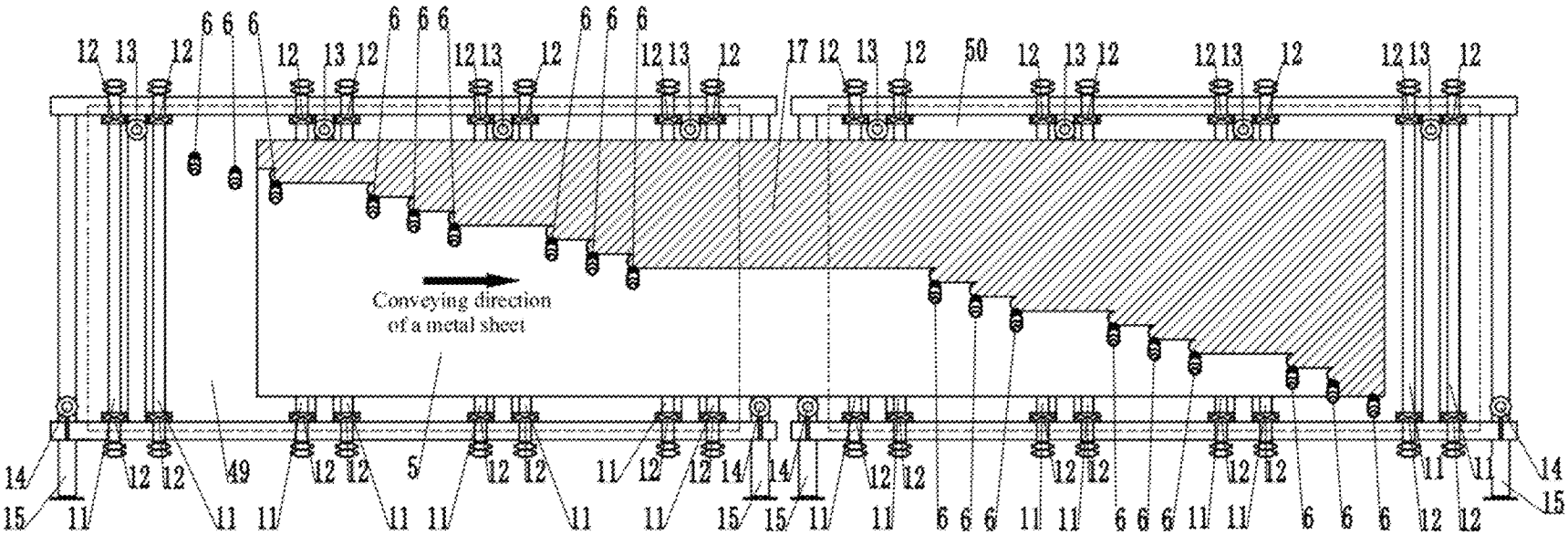
FIG. 8 is a schematic diagram of a cleaning state of a sheet strip passing through a first cleaning box and a second cleaning box disclosed by an embodiment of the disclosure.

In one preferred embodiment, a side guide roller 60 includes an intra-cleaning-box fixed side guide roller 13 and an adjustable side guide roller 14, as shown in FIGS. 6 and 8. The embodiment is described in detail below.

Next, an embodiment of the disclosure discloses a water jet cleaning line, including one or more high-pressure water jet sheet strip sand-blasting descaling cleaning devices (plural devices, such as two, three and four devices, and multiple forms of t combination modes may be adopted) connected successively. An output end of the water jet cleaning line is successively provided with a drying device 55 and a detection device 56 through which the sheet strip 5 may pass. The abrasive left on the surface of the sheet strip 5 is washed and cleaned in the washing box 18 in the cleaning box 7, and the abrasive in each cleaning box 7 is circulated and supplied independently. The drying device 55 is positioned at a rear end of the last clamping mechanism 51, and positioned before the detection device 56. The drying device 55 is used for removing residual water stain after cleaning so that it is convenient for performing online detection of the sheet strip 5 and the next processing of the sheet strip 5. The detection device 56 performs real-time detection on the surface of the sheet strip 5 after it is cleaned and dried, and parameters, such as a pressure, a target distance, and a jet angle «, may be adjusted in time through a control system or by an operator, thereby it is guaranteed to treat the wide and thick specifications of the sheet strips 5 with high surface qualities.

In the present embodiment, the water jet cleaning line includes a forward jet cleaning line and a reverse jet cleaning line which are mutually connected, each of the forward jet cleaning line and the reverse jet cleaning line internally includes one or more high-pressure water jet sheet strip sand-blasting descaling cleaning devices (the specific number is determined according to a size of the sheet strip 5, the surface cleaning difficulty of the sheet strip 5, and a surface cleaning quality requirement of the sheet strip 5) connected successively, in which the descaling nozzles 6 of the forward jet cleaning line face to the same width direction of the sheet strip 5, and the descaling nozzles 6 of the reverse jet cleaning line face to the same width direction of the sheet strip 5, and orientations of the descaling nozzles 6 of the forward jet cleaning line and of the reverse jet cleaning line are symmetrically arranged relative to a vertical plane perpendicular to the width direction of the sheet strip 5. Namely the numbers of the descaling nozzles 6 in the adjacent two high-pressure water jet sheet strip sand-blasting descaling cleaning devices are the same, but the sand-blasting cleaning directions are reverse, thereby two times of the cleaning are performed on the upper and lower surfaces of the sheet strip 5 in reverse sand-blasting cleaning directions, so the surface quality of the sheet strip 5 after cleaning is more even, and a high requirement to the surface cleaning quality of the sheet strip 5 is satisfied. In addition, for the thicker sheet strip 5, two side surfaces of the sheet strip 5 may also be successively cleaned by sand-blasting in the adjacent two high-pressure water jet sheet strip sand-blasting descaling cleaning devices.

In the present embodiment, optionally, the water jet cleaning line may also be arranged in this way: the nozzle groups 53 are uniformly arranged in a gradient along the conveying direction of the water jet cleaning line, while the sand-blasting cleaning operation to the sheet strip 5 with the width B is completed by a single cleaning box 7, with N number of high-pressure water jet sheet strip sand-blasting descaling cleaning devices arranged serially, a sheet strip 5 with the width N*B may be cleaned, and the sand-blasting cleaning of the different width specifications of sheet strips 5 may be achieved.

As shown in FIGS. 6-9, the disclosure further discloses a high-pressure water jet sheet strip sand-blasting cleaning system, including a sheet strip conveying system, a high-pressure water supply system, a high-pressure water jet sand-blasting descaling cleaning device, a washing box, an abrasive supply-recovery-separation system, a sewage recycling treatment system and an intelligent electrical control system.

As shown in FIG. 6 and FIG. 8, the sheet strip conveying system includes a conveying roller way for loading sheet strip 1, a conveying roller way for unloading sheet strip 2, a side positioning pusher 3, a loading-unloading side limiting roller 4, a loading detection device 9, an unloading detection device 10, an intra-cleaning-box horizontal conveying roller 11, an intra-cleaning-box horizontal conveying roller sealing device 12, an intra-cleaning-box fixed side guide roller 13, an adjustable side guide roller 14, and a side guide adjusting mechanism 15.

Figure 7:
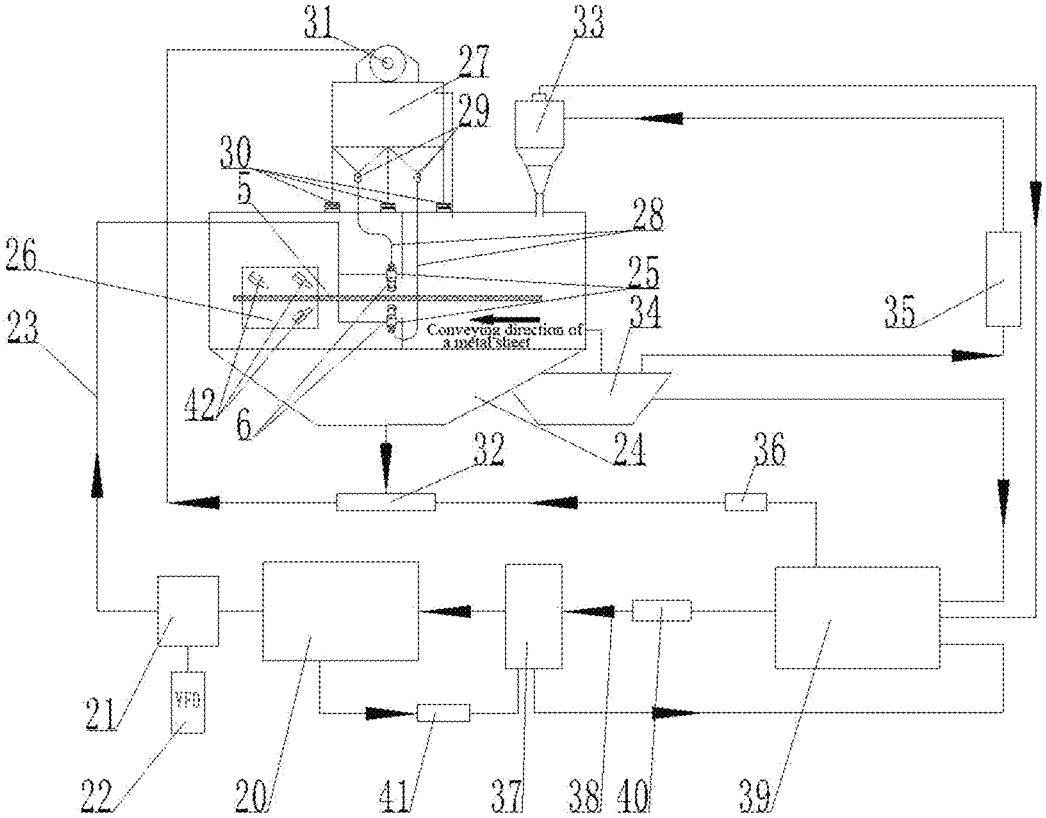
FIG. 7 is a schematic diagram of the main portion of a high-pressure water jet sheet strip sand-blasting cleaning system disclosed by an embodiment of the disclosure.
Figure 9:
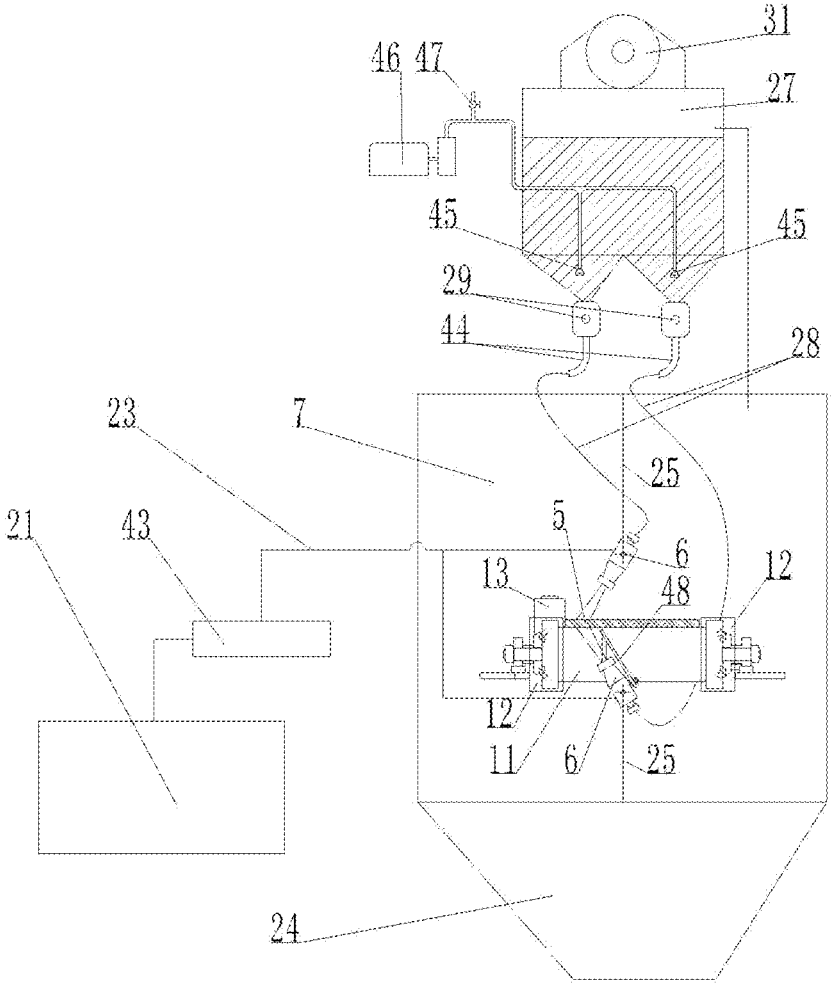
FIG. 9 is a schematic diagram of optionally additional components of a high-pressure water jet sheet strip sand-blasting cleaning system disclosed by an embodiment of the disclosure.

As shown in FIG. 7 and FIG. 9, the high-pressure water supply system includes a water purifying box 20, a high-pressure pump 21, a variable frequency controller 22, and a pressure conveying pipeline 23.

As shown in FIG. 6, the washing box includes a high-pressure washing device 19.

As shown in FIG. 7 and FIG. 9, the high-pressure water jet sand-blasting descaling cleaning device includes a cleaning box 7, an abrasive collecting box 24, a descaling nozzle 6, a descaling nozzle installing frame 25, and a washing device 26.

As shown in FIG. 7 and FIG. 9, the abrasive supply-recovery-separation system includes an abrasive tank 27, a sand supply pipe 28, a sand supply control valve 29, a weight sensor 30, an abrasive screening device 31, a hydraulic conveyer 32, a hydrocyclone 33, an overflow collecting box 34, a slurry pump 35, and a Hydraulic conveyer auxiliary pump 36.

As shown in FIG. 7 and FIG. 9, the sewage recycling treatment system includes a sewage filter 37, a water conveying pipeline 38, a sedimentation tank 39, a sewage pump 40, and a recoil pump 41.

The intelligent electrical control system controls normal start and stop of a water pump, a valve and a motor of the entire cleaning system and detects devices and automatically diagnose and alarm with a PLC program.

The washing box 18 is installed at an output end of the cleaning box 7, and the sheet strip conveying system is installed at the two ends of the inlet of the cleaning box 7 and the outlet of the washing box 18.

The intra-cleaning-box fixed side guide rollers 13 and the adjustable side guide rollers 14 are respectively positioned at two sides of the sheet strip 5 along the conveying direction; the intra-cleaning-box fixed side guide rollers 13 are fixedly arranged at the same side of the sheet strip 5 along the conveying direction and at the side of the jet direction of the descaling nozzles 6, to unilaterally position in the width direction of the sheet strip 5; and the adjustable side guide rollers 14 are arranged at the other side of the sheet strip 5, and automatically adjusted and parallelly moved by the side guide adjusting mechanism 15, to adapt different width specifications of the sheet strips 5, limiting the sheet strip 5 in the width direction, to achieve stable conveying during the cleaning process. The adjustable side guide rollers 14 are positioned at inlet and outlet sides of the total intra-cleaning-box fixed side guide rollers 13 along the conveying direction of the sheet strip 5.

The descaling nozzles 6 jet towards the width direction of the sheet strip 5 (namely jet along a direction perpendicular to the conveying direction of the sheet strip 5), so that the sheet strip 5 is correspondingly subjected to a force F along the width direction of the sheet strip 5 in a cleaning position of the descaling nozzles 6, as shown in FIG. 6, the sheet strip 5 may be deflected from the original conveying direction by such a force F. In order to keep the sheet strip 5 continuously moving along the original conveying direction, the distance L1 or L2 between axes of any three contiguous intra-cleaning-box fixed side guide rollers 13 in the cleaning box 7 and the distance L3 or L4 between the axes of the adjustable side guide roller 14 and the second closest intra-cleaning-box fixed side guide roller 13 to it are less than the length L of the sheet strip 5 to be conveyed.

While the sheet strip 5 enters the descaling nozzles 6 and leaves the descaling nozzles 6, the width limiting is performed by the adjustable side guide rollers 14 and the intra-cleaning-box fixed side guide rollers 13, and while the sheet strip 5 leaves the adjustable side guide rollers 14 and is cleaned midway in the cleaning box 7, the wide positioning is performed by the intra-cleaning-box fixed side guide rollers 13.

While the sheet strip 5 is cleaned and enters and leaves the descaling nozzles 6, the width limiting is always performed on it by at least two intra-cleaning-box fixed side guide rollers 13 or by an adjustable side guide roller 14 and an intra-cleaning-box fixed side guide roller 13.

The intra-cleaning-box fixed side guide roller 13 is arranged between two intra-cleaning-box horizontal conveying rollers 11 between which no descaling nozzle 6 is installed, as to prevent a descaling nozzle 6 from jetting on and impacting the intra-cleaning-box fixed side guide roller 13, at the same time, it may be ensured that the arbitrary sheet strip 5 passes through the cleaning box and a side boundary position at the width positioning side is not changed while being cleaned.

Each of the conveying roller way for loading sheet strip 1 and the conveying roller way for unloading sheet strip 2 is composed of two or more horizontal conveying rollers 16; the intra-cleaning-box horizontal conveying roller 11 is coated with plastic wear-resistant material such as rubber or the like on the part that contacted with the sheet strip 5; the horizontal conveying rollers 16 and the intra-cleaning-box horizontal conveying rollers 11 are horizontally interval-arranged at the lower side of the sheet strip 5, and a variable frequency driving motor or an independent motor is connected to be synchronously driven through a chain wheel and a chain to support and convey the sheet strip 5.

The loading-unloading side limiting rollers 4 are positioned at two sides of the sheet strip 5 along the conveying direction, the side limiting rollers at one side may be fixed and the side limiting rollers at the other side may be adjustable, alternatively the side limiting rollers at the two sides may be adjustable, which are used for the width limiting of the sheet strip 5 in the conveying roller way for loading sheet strip 1 and the conveying roller way for unloading sheet strip 2.

The side positioning pusher 3 is arranged at one side of the conveying roller way for loading sheet strip 1, and arranged parallel to the conveying roller way for loading sheet strip 1, which is used for pushing the sheet strip 5 to a designated position on the conveying roller way for loading sheet strip 1.

The loading detection device 9 and the unloading detection device 10 are respectively arranged on the conveying roller way for loading sheet strip 1 and the conveying roller way for unloading sheet strip 2, distances or positions to be moved of the loading-unloading side limiting rollers 4, the adjustable side guide rollers 14 and the pressure rollers 8 are determined by detecting the width and thickness of the sheet strip 5.

The pressure roller 8 is arranged above the horizontal conveying rollers 16 or the intra-cleaning-box horizontal conveying rollers 11, as to increase a driving friction of the sheet strip 5 during the conveying process.

In the washing box 18, a roller way having the same structure as the conveying roller way for loading sheet strip 1 and the conveying roller way for unloading sheet strip 2 is used for conveying, and the loading-unloading side limiting rollers 4 are used for limiting, or the intra-cleaning-box horizontal conveying rollers 11 and the intra-cleaning-box horizontal conveying roller sealing device 12 are used for conveying and sealing, and the intra-cleaning-box fixed side guide rollers 13, the adjustable side guide rollers 14 and the side guide adjusting mechanism 15 are used for limiting position.

The high-pressure pump 21 is water-supplied by the water purifying box 20, a pressure of pressure water output by the high-pressure pump 21 is adjusted and controlled by the variable frequency controller 22, and the high-pressure pump 21 is connected with the descaling nozzles 6 through the pressure conveying pipeline 23.

The high-pressure washing device 19 and the high-pressure pump 21 are connected by the pressure conveying pipeline, and total attachments on the sheet strip 5 are washed by using high-pressure water.

A descaling nozzle installing frame 25 is installed in the cleaning box 7, the descaling nozzles 6 are installed on the descaling nozzle installing frame 25, an abrasive collecting box 24 is installed at the bottom of the cleaning box 7 and used for collecting the abrasive which finishes the cleaning and sending the collected abrasive back to an abrasive tank 27 through a hydraulic conveyer 32. The parts of the inner walls of the cleaning box 7, that may be jetted by the descaling nozzles 6, are provided with wear-resistant plate (s). The washing device 26 includes flush steel shot nozzles 42, including upper two rows of flush steel shot nozzles and lower one row of flush steel shot nozzles installed on the sheet strip conveying line at a tail part in the cleaning box 7 which are convenient for completely washing the residual abrasive on the surface of the sheet strip 5 down into the abrasive collecting box 24 below the cleaning box 7 after the surface cleaning. The descaling nozzle 6 adopts a detachable combined high-pressure water abrasive homogenizing sprinkler head described in the Chinese patent No.: 201320176948.3.

In the cleaning box 7, the descaling nozzles 6 face to the same width direction of the sheet strip 5 and are arranged in a gradient along the conveying direction of the sheet strip 5, the descaling nozzles 6 are arranged above and below the upper and lower side surfaces of the sheet strip 5 and symmetrically arranged relative to the sheet strip 5, not only it may be guaranteed that the width direction of the sheet strip 5 is successively covered and cleaned by the descaling nozzles 6, but also the cleaning effects of the descaling nozzles 6 are not affected with each other, and it may also be guaranteed that the intra-cleaning-box horizontal conveying rollers 11 are not jetted and damaged by the descaling nozzles 6. An arrangement mode of the descaling nozzles adopts a high-pressure water jet sheet strip cleaning device and a water jet cleaning line described in the Chinese patent No.: 201820842714.0.

The abrasive tank 27 is installed above the cleaning box 7 and in a middle position, an output end thereof is connected with the descaling nozzles 6 by the sand supply pipe 28 to supply sand to the descaling nozzles 6 in the cleaning box 7. The weight sensor 30 is installed below the abrasive tank 27, the abrasive screening device 31 is installed above the abrasive tank 27, the sand supply control valve 29 is installed below a sand discharging port of the abrasive tank 27, and the abrasive tank 27 is connected with the descaling nozzles 6 by the sand supply pipe 28; and the hydraulic conveyer 32 is installed below the abrasive collecting box 24 and connected with the abrasive tank 27 through a pipeline, and the Hydraulic conveyer auxiliary pump 36 is connected with the hydraulic conveyer 32 through a pipeline. The hydrocyclone 33 is installed above the cleaning box 7 and in a front position, a water inlet thereof is connected with the overflow collecting box 34 arranged in an overflow port of a side part of the cleaning box 7 through the slurry pump 35, a lower outlet thereof is connected with the cleaning box 7 so that the abrasive is collected, separated and recovered by the abrasive collecting box 24, and an upper outlet thereof is connected with the sedimentation tank 39 and used for discharging sewage containing waste oxidized scales and fine abrasive. The overflow collecting box 34 is positioned at the side of the cleaning box 7 and in a front position, as to collect the sewage containing the abrasive and the oxidized scales overflowed from the overflow port of the cleaning box 7. A water inlet of the slurry pump 35 is connected with the overflow collecting box 34. A structure of the abrasive tank adopts a high-pressure water jet sand-blasting abrasive sand-supply tank of a Chinese patent No.: 201320177049.5).

A water inlet of the sewage filter 37 is connected with the sewage pump 40 through the water conveying pipeline 38, and a water outlet thereof is connected with the water purifying box 20. A water inlet of the recoil pump 41 is connected with the water purifying box 20 through a pipeline, and a water outlet thereof is connected with the sewage filter 37.

The cleaning box includes a first cleaning box 49 and a second cleaning box 50, the first cleaning box 49 is positioned at a front end of the second cleaning box 50, structures of the first cleaning box 49 and the second cleaning box 50 are the same, namely the first cleaning box 49 and the second cleaning box 50 are serially connected to totally clean the upper and lower surfaces of the sheet strip 5 twice in a coverage-type, alternatively a difference between the structures of the first cleaning box 49 and the second cleaning box 50 is only that the arrangement positions of the descaling nozzles 6 in the width direction of the sheet strip 5 are staggered successively, namely the first cleaning box 49 and the second cleaning box 50 may successively and respectively clean a certain width independently in the width direction so that the upper and lower surfaces of the sheet strip 5 are totally cleaned in the coverage-type.

According to the different width specifications of the sheet strips 5, while the loading-unloading side limiting rollers 4 and the adjustable side guide rollers 14 on the side guide adjusting mechanism 15 are automatically adjusted for limiting, the descaling nozzles 6 in the corresponding width area may be synchronously started and stopped, it is convenient, rapid and energy-saving, at the same time, the cleaning box 7, the intra-cleaning-box horizontal conveying rollers 11, the intra-cleaning-box fixed side guide rollers 13 and the adjustable side guide rollers 14 are protected maximally, and the adaptation is strong.

The additional components of the high-pressure water jet sheet strip sand-blasting descaling cleaning system include the following. The sand supply pipe 28 connected with the abrasive tank 27 and the descaling nozzles 6 is provided with a shaped hard pipe 44, to prevent the sand supply pipe 28 from being deformed and damaged so that the sand supply effect is affected. A water conveying pipeline of a abrasive homogenizing sprinkler head 45 in the abrasive tank 27 is additionally provided with an anti-blocking pipeline with a valve 47 (arranged beside the flushing pump 46), as to prevent the water conveying pipeline from generating a siphon phenomenon that may cause the abrasive homogenizing sprinkler head 45 being blocked by sand. The descaling nozzles 6 installed below the sheet strip 5 may be additionally provided with baffles 48, as to cover an outlet of the descaling nozzles 6 in a vertical direction to prevent the abrasive from the sheet strip 5 or on the top in the cleaning box 7 from vertically falling into the nozzles to block the descaling nozzles 6. The high-pressure filtering device 43 is additionally installed between the high-pressure pump 21 and the descaling nozzles 6, as to improve quality of water entering the descaling nozzles 6, and reduce the blocking of the descaling nozzles 6.

A cleaning process of the sheet strip 5 in the high-pressure water jet sheet strip sand-blasting descaling cleaning system is as follows: a sheet strip 5 is firstly hoisted and placed on the conveying roller way for loading sheet strip 1, and pushed by the side positioning pusher 3, at the same time the width or thickness thereof is detected by the loading detection device 9, the sheet strip 5 is pushed to a designated position after a feedback signal is detected, then the side limiting is completed to the sheet strip 5 by the loading-unloading side limiting rollers 4, and the conveying roller way for loading sheet strip 1 and the intra-cleaning-box horizontal conveying rollers 11 are started to convey the sheet strip 5; when the sheet strip 5 reaches the inlet position of the first cleaning box 49, the adjustable side guide roller 14 positioned at the inlet of the first cleaning box 49 is automatically adjusted by the side guide adjusting mechanisms 15, as to perform the width direction limiting on the entering sheet strip 5, then the sheet strip 5 enters the first cleaning box 49 and the sand-blasting cleaning of the upper and lower side surfaces is performed at the same time; while the sheet strip 5 reaches the outlet position of the first cleaning box 49, the adjustable side guide roller 14 positioned at the outlet of the first cleaning box 49 are automatically adjusted by the side guide adjusting mechanisms 15, as to perform the width direction limiting on the leaving sheet strip 5; the conveying, limiting and cleaning processes of the sheet strip 5 in the second cleaning box 50 are similar, after the sheet strip 5 is cleaned in the first cleaning box 49 and the second cleaning box 50, the sand-blasting cleaning of the sheet strip surface is completed. After that, the sheet strip enters the washing box 18, and the total attachments on the surface thereof are washed by using the high-pressure water. Finally, it is detected by the unloading detection device 10, and the conveying roller way for unloading sheet strip 2 is started to send out the cleaned sheet strip 5, so far, the total cleaning process of the sheet strip 5 in the high-pressure water jet sheet strip sand-blasting descaling cleaning system are completed, the sheet strip 5 is completely cleaned.

In order to prolong storage time of some sheet strips 5, a purging device and a drying device may also be additionally installed after the washing box 8, to dry the surfaces of the sheet strip.

In the present embodiment, optionally, the high-pressure water jet sheet strip sand-blasting descaling cleaning system may also be arranged in this way, a cleaning width of each cleaning box 7 is B, N cleaning boxes 7 in which the descaling nozzles are gradient staggered arranged may be serially connected, so the sheet strip 5 with the width specification of B*N may be cleaned.

Figure 10:
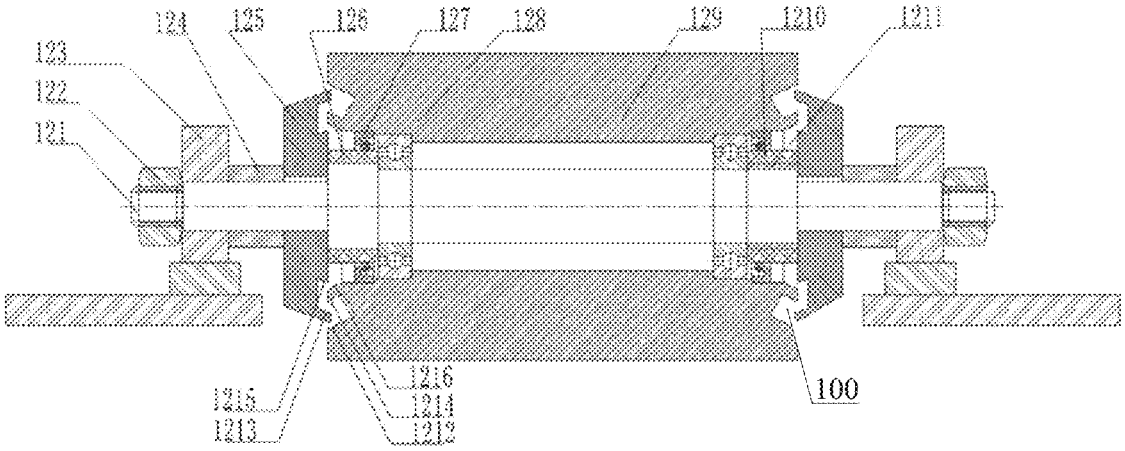
FIG. 10 is an overall section view of an intra-cleaning-box horizontal conveying roller and a sealing device disclosed by an embodiment of the disclosure.
Figure 11:
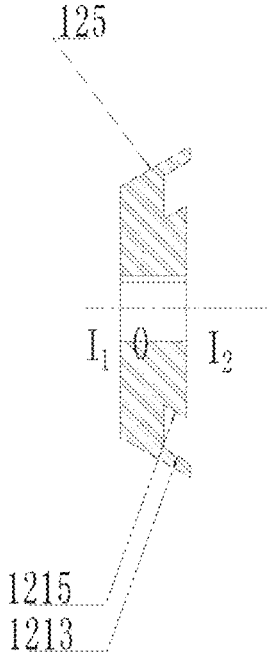
FIG. 11 is a section view of the sealing disk in FIG. 10.
Figure 12:
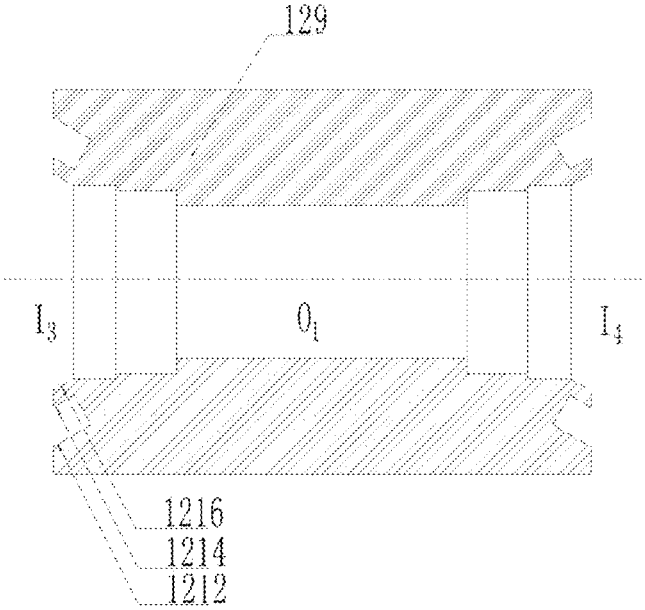
FIG. 12 is a section view of the roller in FIG. 10.

As shown in FIGS. 10-12, in one preferred embodiment, the intra-cleaning-box horizontal conveying roller sealing device 12 adopts a sealing structure of a sealing disk and a zigzag channel. The intra-cleaning-box horizontal conveying roller 11 includes a roller 129.

Two ends of the support shaft 121 are thread-connected and fixed on the support components 123 through the nuts 122. From left to right, the support shaft 121 is successively provided with a shaft collar 124, a sealing disk 125, a first sealing element 126, a sealing ring 127, a bearing 128, a roller 129, a bearing 128, a sealing ring 127, a second sealing element 1210, a positioning shaft sleeve 1211, a sealing disk 125, and a shaft collar 124. The roller 129 is radially positioned on the support shaft 121 through the bearings 128 installed at two ends of the roller, and the roller 129 can be rolled through the bearings 128. The sealing disk 125 is axially positioned through the shaft collar 124 and a shaft shoulder of the support shaft 121 or the positioning shaft sleeve 1211. Inner rings of the bearings 128 are axially positioned through the shaft shoulder of the support shaft 121 or the positioning shaft sleeve 1211, and outer rings of the bearings 128 are axially positioned through the roller 129, and the bearings 128 and the roller 129 are mutually axially positioned.

In order to prevent the bearings 128 from being damaged due to impacting and wearing of the abrasive jet flow, the sealing disk 125 is arranged to prevent steel shot/sand from directly impacting the bearings 128 and the sealing element. The sealing disks 125 are installed on the support shaft 121 and tightly adjacent to two end faces of the roller 129. The sealing disks 125 are circumferentially provided with a first groove, the two end faces of the roller 129 are circumferentially provided with a second groove, the first groove and the second groove are staggered arranged to form the zigzag channel. The zigzag channel is S-shaped approximately, and a boundary thereof includes sealing disk slopes on the sealing disk 125 and roller slopes on the roller 129. The sealing disk slopes includes a second slope 1213 and a fourth slope 1215 for forming a side wall of the first groove. The roller slopes includes a first slope 1212 and a third slope 1214 for forming a side wall of the second groove, and a fifth slope 1216 close to a center hole of the roller. The third slope 1214 and the fifth slope 1216 are radially located between the second slope 1213 and the fourth slope 1215, and the second slope 1213 is radially located between the first slope 1212 and the third slope 1214. In addition, a slope formed by a circumferential outer wall of the sealing disk 125 is radially located between the first slope 1212 and the third slope 1214.

When the high-pressure water jet sheet strip sand-blasting descaling cleaning device is normally running, a horizontal limiting support roller installed in a main cleaning unit may be subjected to the impact of the abrasive bounced from every directions. Five slopes of the first slope, the second slope, the third slope, the fourth slope and the fifth slope are arranged between the sealing disk 125 and the roller 129, which form multiple bounce slow-down surfaces between the sealing disk 125 and the roller 129. Even a part of the abrasive enters the gap between the sealing disk 125 and the roller 129, due to the existence of the multiple bounce surfaces, the abrasive is bounced repeatedly by each slope to change the direction and reduce the speed, the impact force is reduced, and an moving path is prolonged, thereby the amount of the abrasive entering the gap between the sealing disk 125 and the roller 129 is reduced, and the direct damage by the abrasive to the sealing element or the bearings is reduced.

An included angle in a direction $OI_2$ between the slope of the sealing disk 125 and the axis $I_1I_2$ is $\alpha$, and an included angle in a direction $O_1I_3$ between the slope of the roller 129 and the axis $I_3I_4$ is $\beta$, the two angles $\alpha$ and $\beta$ are acute angles. An included angle between the slope formed by the circumferential outer wall of the sealing disk 125 and the $OI_2$ is an acute angle. When the roller 129 is rotated, due to the existence of a centrifugal force, the abrasive entering the gap between the sealing disk 125 and the roller 129 is easily thrown out, the amount of the abrasive that may damages the sealing element or the bearings is also reduced, and the phenomenon, the lock of the horizontal limiting roller is effectively prevented.

Figure 13:
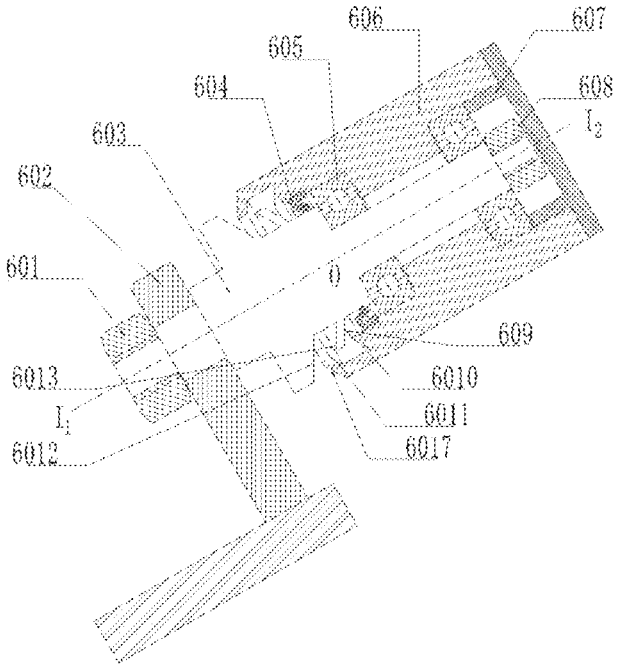
FIG. 13 is an overall section view of a side guide roller disclosed by an embodiment of the disclosure.

As shown in FIG. 13, in one preferred embodiment, the intra-cleaning-box fixed side guide rollers 13 and the adjustable side guide rollers 14 adopt a limiting roller with a sealing structure of the zigzag channel. The limiting roller includes a second roller 606.

A second support shaft 603 is thread-connected and fixed on a support element 602 through a 1-st nut at the lower end. From top to bottom, the second support shaft 603 is successively provided with a second sealing ring 604, a second bearings 605, a second roller 606, a second bearing 605, and a 2-nd nut 608. The second roller 606 is radially positioned on the second support shaft 603 through the second bearings 605 installed at two ends of the second roller. An upper end face of the second roller 606 is tightly covered by a roller cover 607, and the upper end of the second roller is completely sealed, as to protect the second bearing 605 at the upper end of the roller from being impacted and worn by the abrasive. Two second bearings 605 and the second roller 606 on the second support shaft 603 are mutually positioned through a shaft shoulder of the support shaft and the 2-nd nut 608, and the second roller 606 is axially positioned by the two second bearings 605 and rolling is achieved.

In order to prevent the second bearing 605 at the lower end from being damaged due to impacting and wearing of the abrasive, the second support shaft 603 is circumferentially provided with a first flange and a second flange above the first flange, a first groove is formed between the first flange and the second flange, an inner side, close to the center hole, of the lower end of the second roller 606 is provided with a second groove, the first groove and the second groove are staggered arranged to form a zigzag channel. The zigzag channel approximately has an S-shape, a boundary of the zigzag channel includes support shaft slopes on the second support shaft 603 and roller slopes on the second roller 606, an included angle between the support shaft slope and $OI_1$ is an acute angle, and an included angle between the roller slope and $OI_2$ is an acute angle. The support shaft slopes includes a 1-th slope 6012 and a 3-th slope 6013 for forming a side wall of the first groove, and a 5-th slope 609 for forming a side wall on the second flange. The roller slopes includes a 2-th slope 6011 and a 4-th slope 6010 for forming a side wall of the second groove, and a 6-th slope 6017 at an outer side of a lowermost end of the second roller 606. The 2-th slope 6011 is axially located between the 1-th slope 6012 and the 3-th slope 6013, the 5-th slope 609 and the 3-th slope 6013 are axially located between the 2-th slope 6011 and the 4-th slope 6010. An included angle between the 6-th slope 6017 formed by the lower end face of the second roller 606 and $OI_2$ is an acute angle, and the 6-th slope 6017 is axially located between the 1-th slope 6012 and the 3-th slope 6013.

Six slopes of the 1-th slope 6012, the 2-th slope 6011, the 3-th slope 6013, the 4-th slope 6010, the 5-th slope 609 and the 6-th slope 6017 are arranged between the second roller 606 and the second support shaft 603, as to form multiple bounce surfaces. When the high-pressure water jet sheet strip sand-blasting descaling cleaning device is normally running, a slantwise limiting roller installed in the main cleaning unit may be subjected to the impact of the abrasive bounced from every directions. Even a part of the abrasive enters a gap between the second roller 606 and the second support shaft 603, due to the existence of the multiple bounce surfaces, the steel shot is repeatedly bounced to change the direction and reduce the speed, thus the impact force thereof is reduced, and the moving path thereof is prolonged, thereby an amount of the abrasive left in the gap between the second roller 606 and the second support shaft 603 is reduced, and the damage of the abrasive to the second sealing ring 604 or the second bearing 605 is reduced.

The above are only the preferred embodiments of the disclosure, and are not used to limit the disclosure. Various modifications and changes may be made to the disclosure by those skilled in the art. Any modifications, equivalent replacements, improvements and the like made within the spirit and principle of the disclosure shall be included in the scope of protection of the disclosure.

The invention claimed is:

1. A high-pressure water jet sheet strip sand-blasting descaling cleaning system, comprising:

at least one high-pressure water jet sheet strip sand-blasting descaling cleaning device, wherein the at least one high-pressure water jet sheet strip sand-blasting descaling cleaning device comprises a cleaning box, a washing box and descaling nozzles for jetting and cleaning a sheet strip, the washing box is arranged at an output end of the cleaning box, the descaling nozzles face to a same width direction of the sheet strip and are arranged in a gradient along a conveying direction of the cleaning box to jet the sheet strip in a covering manner, each of the descaling nozzles jets and diffuses on the sheet strip to form jet influence areas, each of the jet influence areas comprises a jet cleaning area which has a direct jet cleaning effect on the sheet strip, and one of the jet influence areas formed by a first descaling nozzle of the descaling nozzles earlier entering above the sheet strip is partially overlapped with the jet cleaning area formed by a second descaling nozzle of the descaling nozzles later entering above the sheet strip, and an abrasive collecting box, a high-pressure water supply system, an abrasive supply-recovery-separation system and a sewage recycling treatment system;

wherein the high-pressure water supply system comprises a water purifying box and a high-pressure pump, one end of the high-pressure pump is connected with the water purifying box, and a second end of the high-pressure pump is connected with the descaling nozzles;

the abrasive supply-recovery-separation system comprises an abrasive tank, an abrasive screening device, a hydraulic conveyer, an overflow collecting box and a hydrocyclone;

the abrasive tank is positioned below the abrasive screening device, one end of the abrasive tank is connected with the abrasive screening device, and a second end of the abrasive tank is connected with the descaling nozzles;

the cleaning box is positioned below the abrasive tank, and the abrasive collecting box is positioned below the sheet strip;

the hydraulic conveyer is positioned below the abrasive collecting box, one end of the hydraulic conveyer is connected with the abrasive collecting box, and a second end of the hydraulic conveyer is connected with the abrasive screening device for sending collected abrasive back to the abrasive tank;

the overflow collecting box is positioned at an output end of an overflow port of the cleaning box, a water inlet of the hydrocyclone is connected with the overflow collecting box through a slurry pump, an outlet at a lower part of the overflow collecting box is connected with the cleaning box to recover the abrasive, and a water outlet at an upper part of the overflow collecting box is connected with a sedimentation tank for discharging sewage;

the sewage recycling treatment system comprises a sewage filter and the sedimentation tank, one end of the sewage filter is connected with the water purifying box, and a second end of the sewage filter is connected with the sedimentation tank.

2. The high-pressure water jet sheet strip sand-blasting descaling cleaning system of claim 1, wherein an upper side of the sheet strip is provided with at least one upper descaling nozzle of the descaling nozzles, and a lower side of the sheet strip is provided with at least one lower descaling nozzle of the descaling nozzles, and the at least one upper descaling nozzle is symmetric to the at least one lower descaling nozzle relative to the sheet strip.

3. The high-pressure water jet sheet strip sand-blasting descaling cleaning system of claim 1, wherein an input end of the cleaning box and an output end of the washing box are provided with clamping mechanisms for pushing and pulling the sheet strip, each of the clamping mechanisms comprises rolling conveying wheels for clamping up and down to roll the sheet strip.

4. The high-pressure water jet sheet strip sand-blasting descaling cleaning system of claim 1, further comprising multiple groups of intra-cleaning-box horizontal conveying rollers for conveying the sheet strip, wherein the intra-cleaning-box horizontal conveying rollers form a conveying line for conveying the sheet strip, and two sides of the conveying line are provided with side guide rollers.

5. The high-pressure water jet sheet strip sand-blasting descaling cleaning system of claim 4, wherein two descaling nozzles of the descaling nozzles symmetrically arranged relative to the sheet strip form a nozzle group, multiple neighboring nozzle groups form a descaling unit, the intra-cleaning-box horizontal conveying rollers and the side guide rollers are arranged at intervals along the conveying line, the descaling unit is arranged between the intra-cleaning-box horizontal conveying rollers and the side guide rollers, and the descaling nozzles jet along a direction perpendicular to a conveying direction of the sheet strip.

6. The high-pressure water jet sheet strip sand-blasting descaling cleaning system of claim 4, wherein each of the intra-cleaning-box horizontal conveying rollers comprises a first roller, and the first roller is radially positioned on a support shaft through bearings installed at two ends of the first roller;

each of the intra-cleaning-box horizontal conveying rollers is sealed by an intra-cleaning-box horizontal conveying roller sealing device, the intra-cleaning-box horizontal conveying roller sealing device comprises sealing disks, each of the sealing disks is installed on the support shaft and adjacent to a respective one of two end faces of the first roller; and a zigzag channel for blocking the abrasive by slowing the abrasive down and throwing the abrasive out with the help of a centrifugal force is set between each one of the sealing disks and the respective one of the two end faces of the first roller.

7. The high-pressure water jet sheet strip sand-blasting descaling cleaning system of claim 6, wherein the sealing disks are circumferentially provided with first grooves, and the two end faces of the first roller are circumferentially provided with second grooves, openings of the first grooves and the second grooves face to a direction away from a center line of the support shaft, each of the first grooves and a respective one of the second grooves are staggered to form one of the zigzag channels, and a boundary of each of the zigzag channels comprises a plurality of slopes for slowing down bounce of the abrasive.

8. The high-pressure water jet sheet strip sand-blasting descaling cleaning system of claim 4, wherein each of the side guide rollers comprises an intra-cleaning-box fixed side guide roller and an adjustable side guide roller; wherein at least one of the intra-cleaning-box fixed side guide roller or the adjustable side guide roller is a limiting roller, the limiting roller comprises a second roller, the second roller is radially positioned on a second support shaft through second bearings installed at two ends of the second roller, a zigzag channel for blocking the abrasive to slow the abrasive down and throw the abrasive out with the help of a centrifugal force is set between a lower end of the second support shaft and a lower end of the second roller.

9. The high-pressure water jet sheet strip sand-blasting descaling cleaning system of claim 8, wherein the limiting roller further comprises a roller cover, an upper end face of the second roller is covered by the roller cover to completely seal an upper end of the second roller; and the zigzag channel is formed by a combination of a flange set on the second support shaft and a groove set on the second roller, and a boundary of the zigzag channel comprises a plurality of slopes for slowing down bounce of the abrasive.

10. The high-pressure water jet sheet strip sand-blasting descaling cleaning system of claim 4, wherein the side guide rollers comprise intra-cleaning-box fixed side guide rollers and adjustable side guide rollers;

the intra-cleaning-box fixed side guide rollers are fixedly arranged at a first side of the sheet strip along the conveying direction of the cleaning box and the descaling nozzles jet towards the first side; and the adjustable side guide rollers are arranged at a second side, opposite to the first side, of the sheet strip along the conveying direction of the cleaning box, the adjustable side guide rollers are positioned at outer sides of two intra-cleaning-box fixed side guide rollers of the intra-cleaning-box fixed side guide rollers respectively close to an entrance and an exit of the cleaning box, and while the sheet strip leaves the adjustable side guide rollers and is cleaned midway in the cleaning box, width positioning is performed on the sheet strip by the intra-cleaning-box fixed side guide rollers.

11. The high-pressure water jet sheet strip sand-blasting descaling cleaning system of claim 10, wherein in the cleaning box, a distance in the conveying direction of the cleaning box between axes of any three contiguous intra-cleaning-box fixed side guide rollers of the intra-cleaning-box fixed side guide rollers and a distance in the conveying direction of the cleaning box between an axis of one of the adjustable side guide rollers and an axis of a second one of the any three contiguous intra-cleaning-box fixed side guide rollers closest to the one of the adjustable side guide rollers are configured to receive the sheet strip to be conveyed.

12. The high-pressure water jet sheet strip sand-blasting descaling cleaning system of claim 10, wherein while the sheet strip is cleaned, width limiting is performed on the sheet strip by at least two intra-cleaning-box fixed side guide rollers of the intra-cleaning-box fixed side guide rollers, or by the intra-cleaning-box fixed side guide rollers and the adjustable side guide rollers jointly.

13. The high-pressure water jet sheet strip sand-blasting descaling cleaning system of claim 10, wherein the intra-cleaning-box fixed side guide rollers, in the cleaning box, are arranged between two intra-cleaning-box horizontal conveying rollers of intra-cleaning-box horizontal conveying rollers between which no descaling nozzle is installed; each of the adjustable side guide rollers is automatically adjusted and horizontally moved through a side guide adjusting mechanism, so as to adapt to sheet strips with different specification widths.

14. The high-pressure water jet sheet strip sand-blasting descaling cleaning system of claim 10, wherein a pressure roller is arranged on the intra-cleaning-box horizontal conveying rollers, and the sheet strip is conveyed by being clamped therebetween.

15. The high-pressure water jet sheet strip sand-blasting descaling cleaning system of claim 10, wherein an entrance side of the cleaning box is provided with a conveying roller way for loading sheet strip and an exit side of the cleaning box is provided with a conveying roller way for unloading sheet strip, wherein at the conveying roller way for loading sheet strip and the conveying roller way for unloading sheet strip, two sides of a conveying direction of the sheet strip are provided with loading-unloading side limiting rollers, and wherein while the sheet strip is totally or partially positioned on the conveying roller way for loading sheet strip or the conveying roller way for unloading sheet strip, width limiting is performed on the sheet strip.

16. The high-pressure water jet sheet strip sand-blasting descaling cleaning system of claim 15, wherein each of the conveying roller way for loading sheet strip and the conveying roller way for unloading sheet strip is composed of two or more horizontal conveying rollers, and pressure rollers are arranged on the two or more horizontal conveying rollers.

17. The high-pressure water jet sheet strip sand-blasting descaling cleaning system of claim 15, further comprising a loading detection device and an unloading detection device, wherein each of the conveying roller way for loading sheet strip and the conveying roller way for unloading sheet strip is composed of two or more horizontal conveying rollers, and pressure rollers are arranged on the two or more horizontal conveying rollers, and wherein the loading detection device and the unloading detection device are respectively arranged on the conveying roller way for loading sheet strip and the conveying roller way for unloading sheet strip and are configured for determining a distance or a position to be moved of the loading-unloading side limiting rollers, the adjustable side guide rollers and the pressure rollers through detecting a width and a thickness of the sheet strip.

* * * * *